US006508047B1

(12) United States Patent
Groppi

(10) Patent No.: US 6,508,047 B1
(45) Date of Patent: Jan. 21, 2003

(54) METHOD AND APPARATUS FOR CAPPING CONTAINER CANS FOR FOOD PRODUCTS AND DRINKS

(75) Inventor: Silvano Groppi, Parma (IT)

(73) Assignee: Bantam Engineers Limited, London (GB)

( * ) Notice: Subject to any disclaimer, the term of this patent is extended or adjusted under 35 U.S.C. 154(b) by 0 days.

(21) Appl. No.: 09/529,633

(22) PCT Filed: Oct. 15, 1998

(86) PCT No.: PCT/EP98/06971

§ 371 (c)(1),
(2), (4) Date: May 11, 2000

(87) PCT Pub. No.: WO99/24324

PCT Pub. Date: May 20, 1999

(30) Foreign Application Priority Data

Oct. 31, 1997 (IT) ..... RE97A0083
May 18, 1998 (IT) ..... RE98A0055

(51) Int. Cl.[7] ..... B65B 31/04

(52) U.S. Cl. ..... 53/432; 53/48.2; 53/397; 53/398; 53/488; 206/150; 294/87.2

(58) Field of Search ..... 53/432, 478, 397, 53/398, 449, 488, 329.3–329.5, 48.2; 206/150; 294/87.2

(56) References Cited

U.S. PATENT DOCUMENTS

| | | | | | |
|---|---|---|---|---|---|
| 3,488,911 | A | * | 1/1970 | Poupitch | 53/170 |
| 3,871,699 | A | * | 3/1975 | Hatfield | 206/145 |
| 4,281,502 | A | | 8/1981 | Bonkowski | |
| 4,724,655 | A | * | 2/1988 | Lew | 53/398 |
| 5,088,269 | A | * | 2/1992 | Thelen | 53/398 |
| 5,647,497 | A | * | 7/1997 | Labbe | 220/257 |

FOREIGN PATENT DOCUMENTS

| | | |
|---|---|---|
| EP | A559293 | 9/1993 |
| FR | A2320241 | 3/1977 |
| WO | A1-9804459 | 2/1998 |

* cited by examiner

*Primary Examiner*—Rinaldi I. Rada
*Assistant Examiner*—Thanh Truong
(74) *Attorney, Agent, or Firm*—Birch, Stewart, Kolasch & Birch, LLP

(57) ABSTRACT

A film of thermoformable plastic material is heated and positioned on the upper part of a group of cans, the film is made to adhere to the surface of said upper part of the group of cans by a thrust action, acting on the top of the film, exerted by a deformable elastic pad in the regions surrounded by the can clinching rim, to urge the film downwards, that film portion adhering to the upper part of the group of cans is separated from the rest of the film, the film is previously heated to an appropriate temperature such that, following cooling, it retains its shape and remains adhering to the surface of said upper part.

15 Claims, 10 Drawing Sheets

FIG. 7
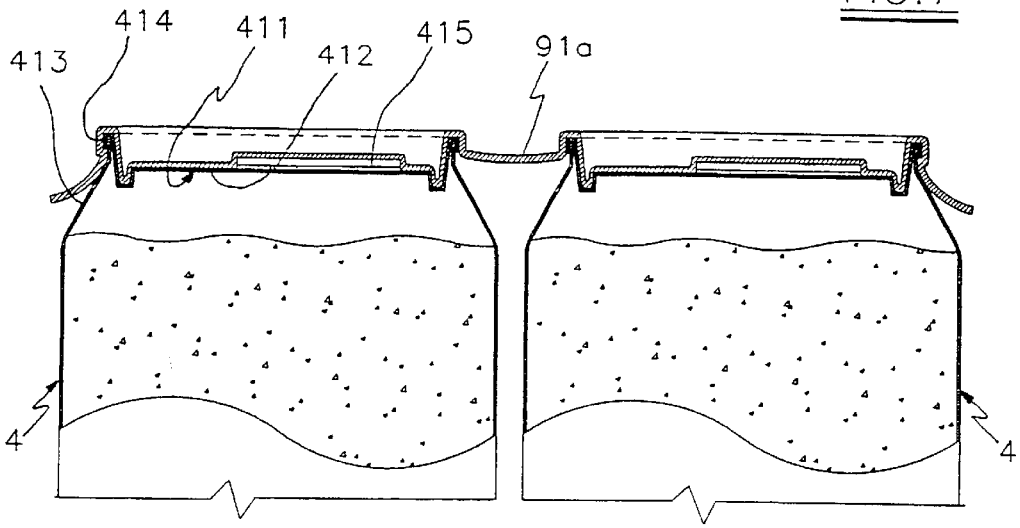
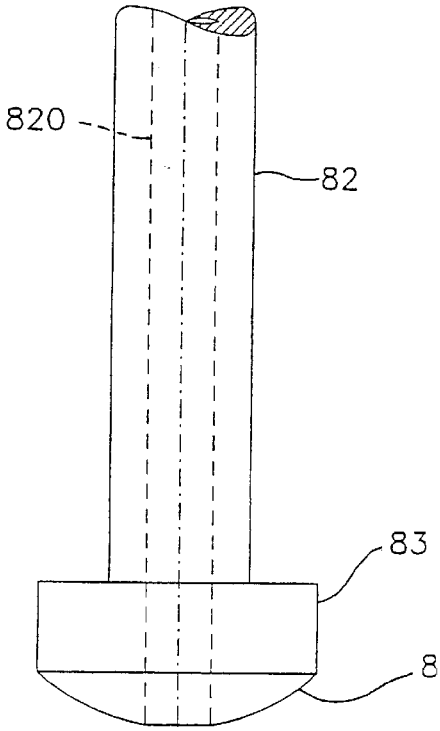
FIG. 8A
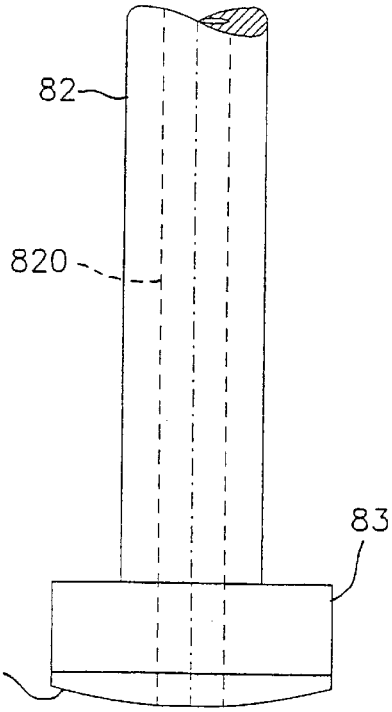
FIG. 8B

METHOD AND APPARATUS FOR CAPPING CONTAINER CANS FOR FOOD PRODUCTS AND DRINKS

This application is the national phase under 35 U.S.C. §371 of PCT International Application No. PCT/EP98/06971 which has an International filing date of Oct. 15, 1998, which designated the United States of America.

TECHNICAL FIELD

This invention concerns the hygienic protection of container cans for food products and drinks, and in particular drink cans having in their upper end a tear-off opening through which the drink is consumed possibly by bringing the can directly to the mouth

BACKGROUND ART

The widespread practice of conserving drinks in cans has raised the general problem of safeguarding the health of the user. In this respect, after being filled, the cans are transported and stored without it in practice being possible to protect them from dust or other more dangerous contaminants, making the consumption of the liquid highly anti-hygienic whether the liquid is poured into a tumbler, or, much more serious, whether the user drinks it directly from the can.

The situation is further aggravated by the appearance of cans in which the opening tab is not pulled off, but instead bent down into the interior of the can, into direct contact with its contents.

There is therefore the need to protect the can upper end containing the opening tab from dust and other contaminants.

Method are known to protect the top of cylindrical objects having the same general shape of the cans:

FR-A-2 320 241 discloses a method and an Apparatus for covering a group of batteries according to which the batteries are covered by a plastic sheet which is moulded over the battery buds by the application of heat and pressure onto the material, realizing a cover for each single battery of the group.

The batteries may be arranged in a number of patterns, in single or double rows or in a circle. A groove in the inside of the cover allows air to escape from the cover.

This type of packing is not suitable for cans, because of the different configuration of their upper part that prevents the cover to adhere perfectly to the can top.

The problem to protect the top of cans from dust and other contaminants has been solved by the solution disclosed in the copending application PCT/EP97/03716.

Said solution comprises heating a film of thermoformable plastic material and positioning it on the upper part of the can, then making it adhere to the surface of said upper part by extracting the air contained between this surface and the film. Finally, the film portion adhering to the can upper part is separated from the rest of the film. During the described procedure, the film is heated to a suitable temperature such that the film is able to satisfy the conditions for thermoformability, after which, by rigidifying following cooling, it remains intimately adhering to the surface which it covers, and retains its shape.

A cap is obtained formed from a film portion which mates with and covers the upper part of the can, to be easily removed from the can and replaced thereon to cover the region comprising the can opening and the entire can upper part and upper edge contacted by the lips, so maintaining this under positively hygienic conditions.

Improvements are also known in which the covering means are formed for groups of at least two cans, to provide packs of two or more cans joined by a single support sheet, which simultaneously protects their lid from contamination.

The aforedefined state of the art is described in International Application PCT/EP97/03716 published as WO98/04459 in the name of the present applicant.

The method and apparatus described in said WO98/04459 are susceptible to further improvements concerning mainly the extraction of the air contained between the film protecting the upper part of the can and its lid.

In the known art, the vacuum required to extract the air is easier to obtain the smaller the air quantity to be extracted.

The object of this patent is therefore to considerably reduce the air quantity to be extracted, and possibly eliminate it completely with consequent plant simplification.

According to the invention, to achieve these objects a film of thermoformable plastic material is heated and positioned on the upper part of a can or group of cans, and is made to adhere over the maximum possible area to the surface of said upper part by a thrust action which acts on the top of the film to urge the film downwards.

According to the improvement, said thrust action can be due either to the action of a convex deformable elastic pad which is pressed onto the upper part of the can to cause the film to adhere starting from the can center, or to the dynamic action of a compressed air jet directed towards the center of the can lid. In both cases it is advisable for the thrust action to be aided by subjecting that part of the film resting on the lid to vacuum acting from below to also eliminate the very small residual air pockets which tend to form at the lid periphery, in proximity to the projecting rim, as a result of the attachment of the lid to the top of the container.

According to a particularly improved embodiment of the invention, it has been found possible to totally extract the air even if a vacuum is absent.

All the objects of the invention are attained by a machine having the characteristics defined in the claims.

BRIEF DESCRIPTION OF THE DRAWINGS

The merits and the constructional and functional characteristics of the invention will be apparent from the detailed description of different possible embodiments thereof given hereinafter by way of non-limiting example and illustrated in the accompanying figures.

FIG. 7 is a section through a two-can pack resulting from the preceding operations.

FIG. 8A and FIG. 8B show two different forms of the presser members 83*a*.

DETAILED DESCRIPTION OF THE DRAWINGS

Figure 1:
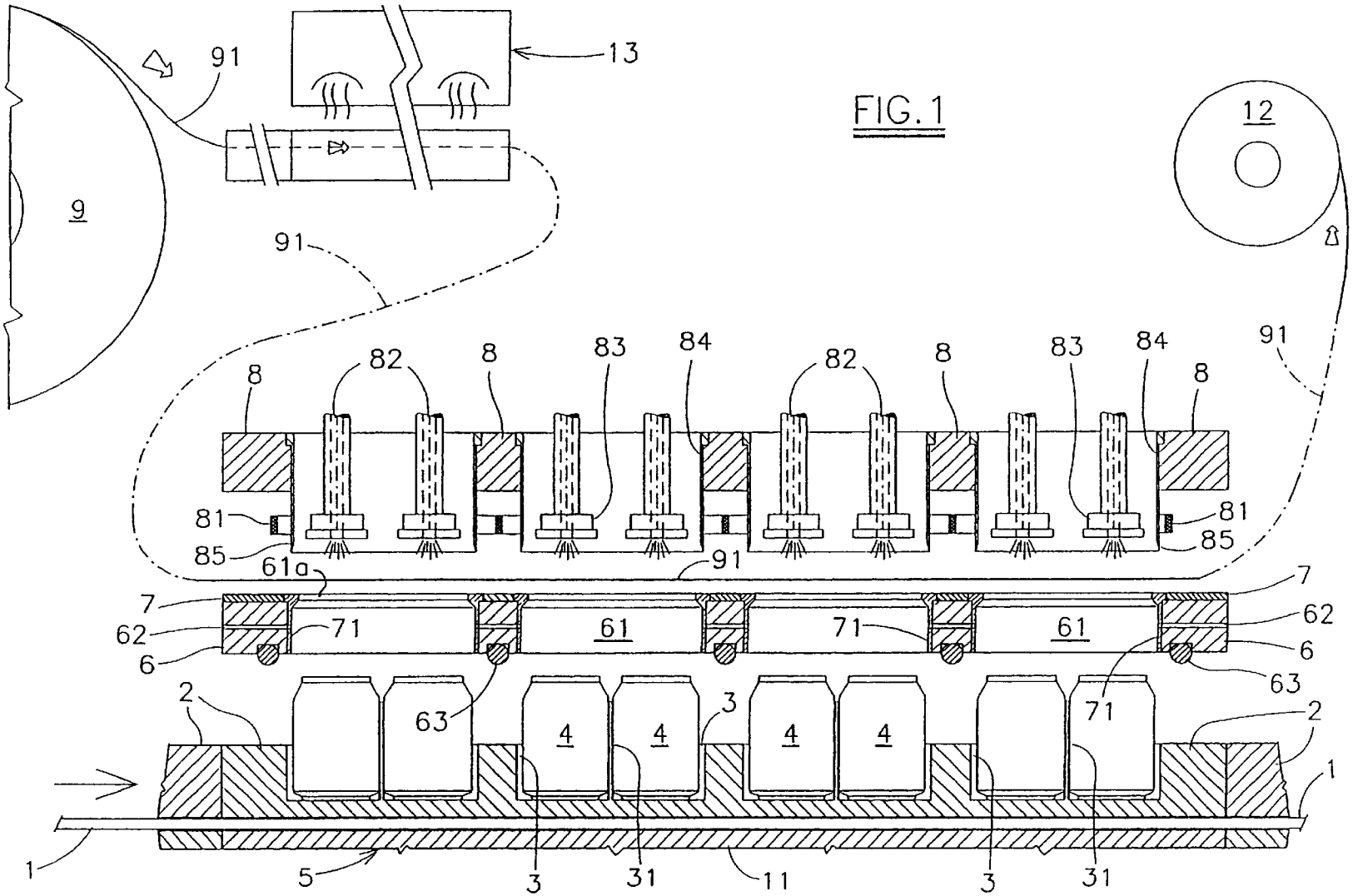
FIG. 1 is a schematic axial section through the apparatus of the invention.

An apparatus and a method for capping cans in groups of two are described hereinafter with reference to FIGS. 1 to 7.

With obvious adaptations, said apparatus and method can also operate on individual cans or on groups composed of more than two cans.

The can, indicated by 4 in the figures, is of known type. Specifically, it comprises an upper part 411 formed from the substantially flat top end 412 of the can, its upper frusto-conical neck 413 and the circular rim 414 which joins the end 412 to the neck 413 (see specifically FIG. 7). In the top end there is a tear-off opening with tab 415, through which the drink is poured.

The apparatus comprises a conveyor 1 driven to advance stepwise, and on which equidistant trays 2 are arranged in succession.

The trays 2 comprise a base with uniformly distributed recesses 3 arranged to each receive a group of cans 4 (comprising two cans in the figures) to be formed into a pack.

More precisely, each recess 3 has in plan view a shape representing the envelope (or circumscription) of the group of cans, and from its base there upwardly extend partitioning baffles 31 occupying the space which would otherwise remain free between one can and the other.

The conveyor belt 1 carries the trays 2 to a processing station, where it is supported by an underlying support surface 11.

Above the station there is located a first vertically movable plate 6 having in plan view the same shape as the underlying tray 2 and comprising through apertures 61 which correspond to the recesses 3 and have the same shape as these latter.

Alternatively the plate 6 is fixed, and that conveyor portion supporting the tray 2 is movable vertically to raise the tray to below the plate.

The plate 6, which will be called the backing/centering plate, comprises channelling 62 connecting the apertures 61 to a vacuum vessel or vacuum pump, neither shown, and a plurality of pneumatic sealing gaskets 63, positioned on the lower surface 65 of the plate 6, such as to project downwards therefrom to surround the lower edge of the through apertures 61.

To the plate 6 there is fixed a thin steel platen 7, which covers its upper surface. The platen 7 is perforated as the plate 6 and is provided with hardened sleeves 71, each positioned to circumscribe a respective through aperture 61 which passes through both the plate 6 and the platen 7. The through apertures 61 are each arranged to receive, with slight clearance, the upper part of the groups of cans 4 contained in the underlying tray 2.

Above the plate 6 and the upper part 411 of the cans but below the grid 81 there travels a web of undefined length of a film 91 of thermoformable plastic material of a type suitable for food, for example HiPS, PP, PET, PVC, PE or PS.

The first plate 6 is overlaid by a second plate 8 positioned above the film 91 and driven by means (of known type, not shown) which cause it to press the film 91 against the upper surface of the underlying backing/centering plate 6.

A film pressing grid 81, movable relative to the plate 8, is fixed to the lower side of the plate 8 and, when lowered, rests on the platen 7. The grid 81 defines a corresponding plurality of apertures 84, each arranged to surround a corresponding aperture 61 in the plate 6, and of which the lower edge is arranged to press the film 91 against the upper surface of the plate 6.

With the grid 81 there are associated thrust/presser means, acting on the top of the film 91, to urge the film downwards until it adheres to the surface of the upper part of the group of cans 4.

In the embodiment illustrated in the figures, these means comprise axial conduits 820 formed within the shanks 82, to feed pressurized air from the top downwards, and positioned through the apertures 84, above the top end 412 of the cans (FIG. 7).

Said shanks are movable vertically upwards and downwards, the air fed by said means also striking, during a first descent portion of the shanks 82, that surface of the film 91 surrounding the mouth of the cans, ie that involving the space between one can and the other.

To the lower end of the conduits 82 there are fixed respective horizontal discs 83, each of which lowerly carries a flat elastically yieldable presser member 83*a* (FIG. 8A and FIG. 8B). The presser members 83*a* are coaxial with the seats defined by the underlying recesses 3 and baffles 31 so that each of the discs 83 is able to descend and press against the lid of a can 4. FIGS. 8A and 8B show two respective different embodiments of the presser members 83*a*. These members have a lower convex surface, arranged to press the plastic film 91 against the top end 412 of the cans 4, its lowest point being substantially positioned on the centre of said end 412.

By virtue of this configuration the thrust action of said presser members commences at the centre of the top end of each can and propagates from the centre to the periphery.

The conduits 820 also pass through the presser members 83*a* along their axes, and open at the centre of their lower surface.

The shanks 82 and the discs 83 are contained within the through apertures 84, which are conjugate with, but slightly wider than, the underlying apertures 61 in the centering plate.

Each of the apertures 84 carries a downwardly projecting cylindrical blade 85 having a closed profile circumscribing, at a short distance therefrom, the edge of the through apertures,61, and arranged to interact with the sleeves 71 of the platen 7.

The cutting edge of the cylindrical blade 85 is continuous along that part involving the external line circumscribing the group of cans, but is interrupted along any part involving the region between individual cans, where it creates a tear-off line.

The film unwinding from the reel 9 passes through the station 5 immediately above the platen 7, and either rewinds, as scrap, on a reel 12 positioned downstream or is drawn into a mill for immediate grinding.

A tunnel 13 for heating the film 91 is positioned between the reel 9 and the station 5.

Figure 13:
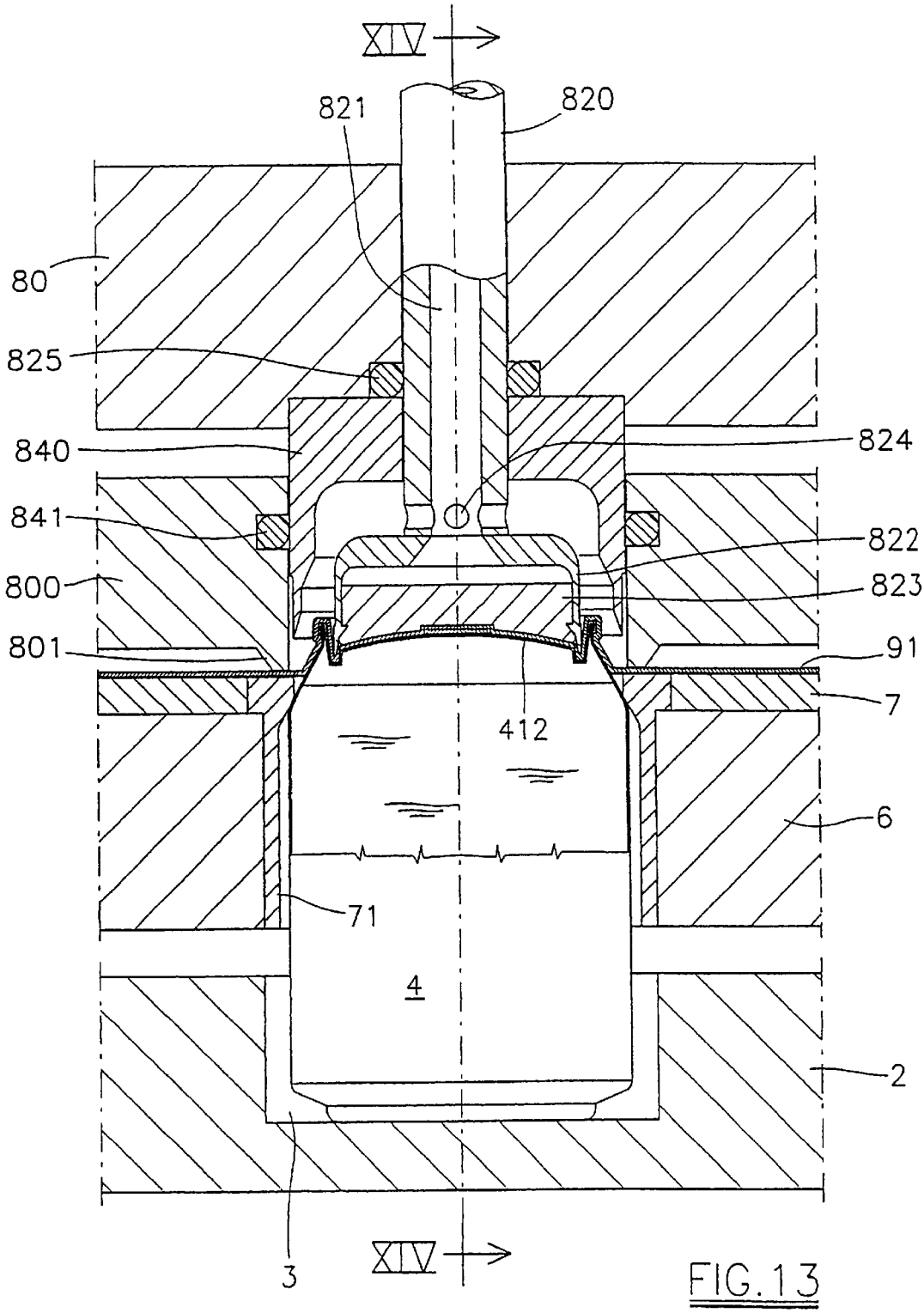
FIG. 13 is a schematic axial section through a further embodiment of the invention
Figure 14:
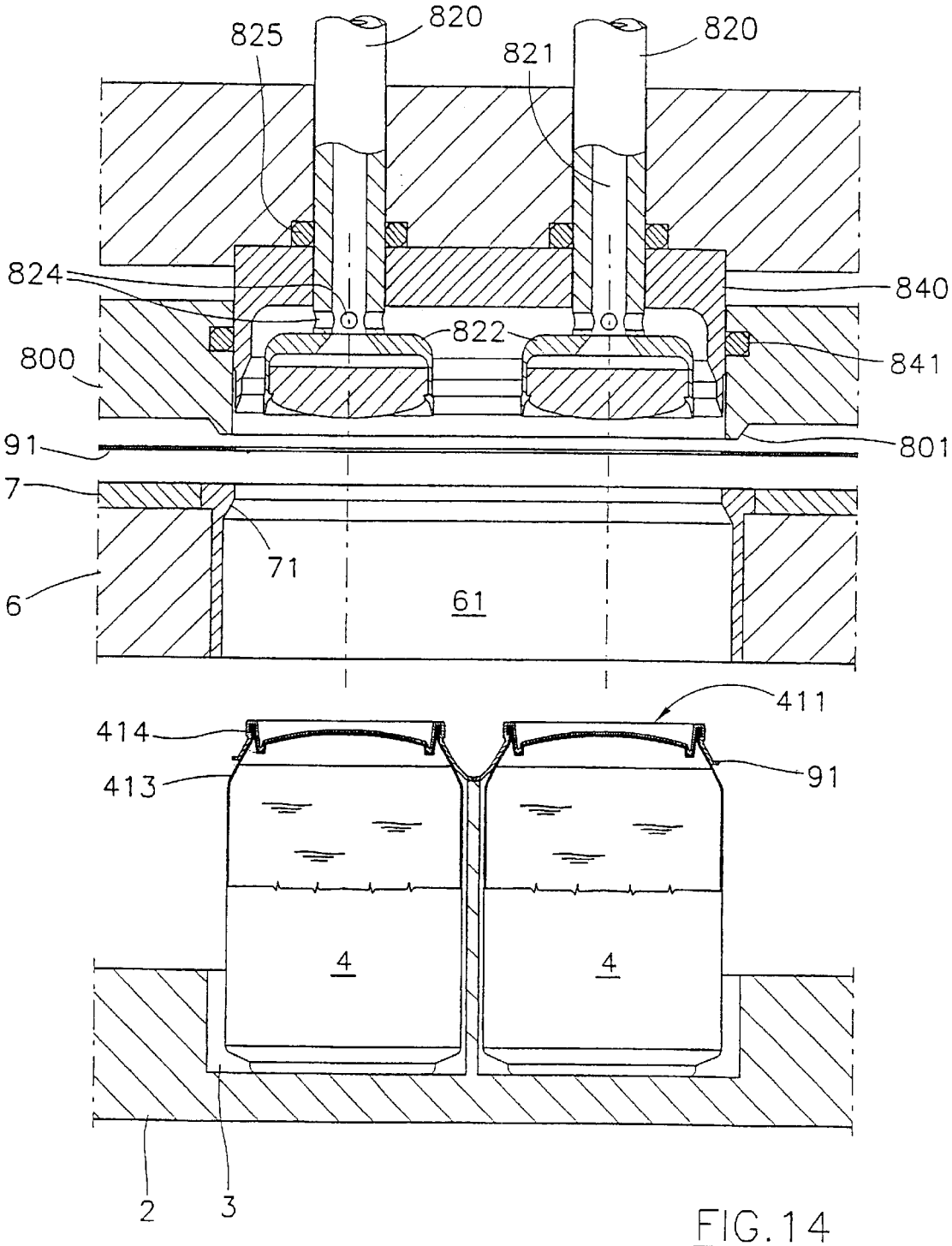
FIG. 14 is a section on the plane XIV—XIV indicated in FIG. 13, in a different operating position.
Figure 15:
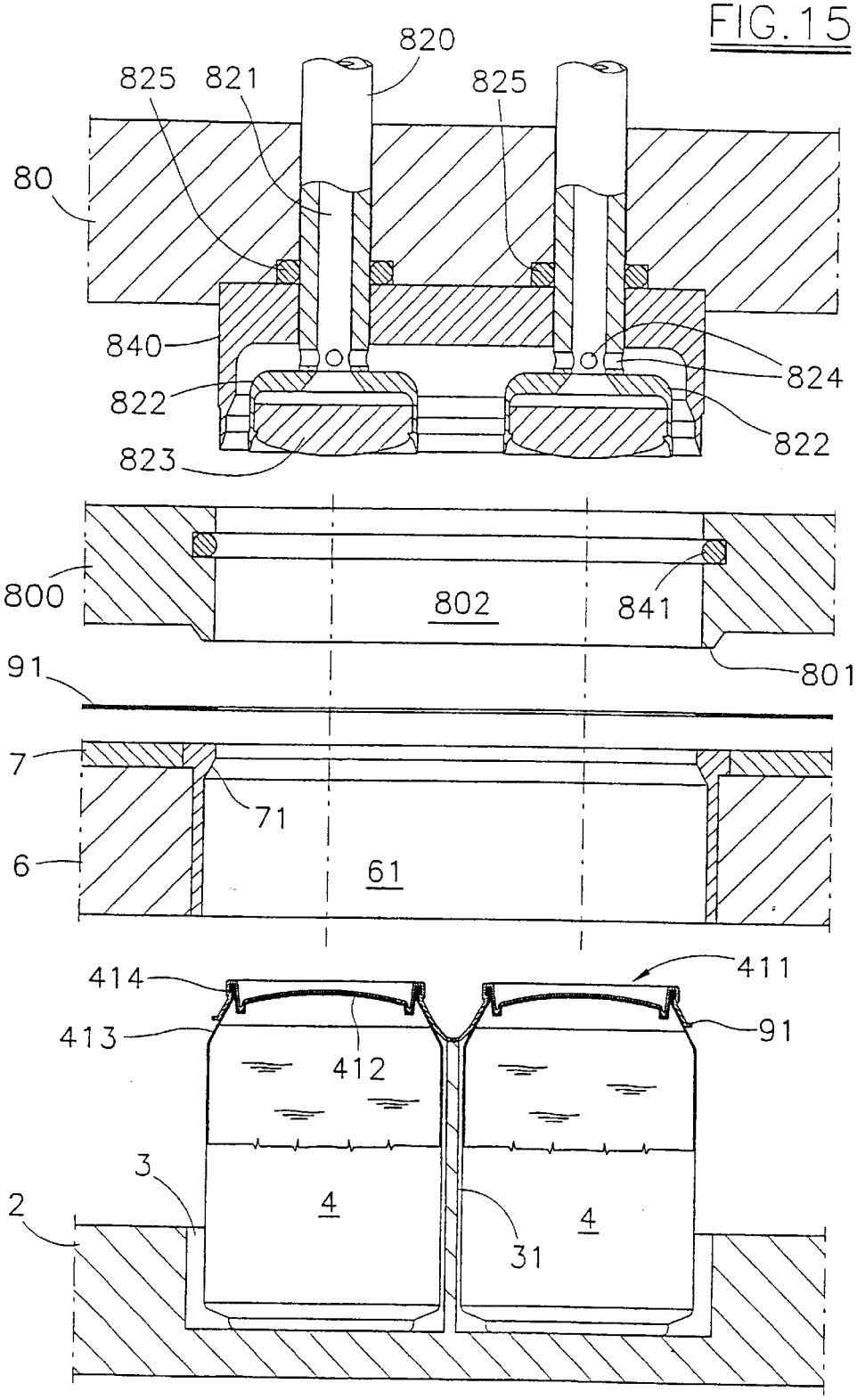
FIG. 15 is an exploded view corresponding to FIG. 14.

In a further embodiment shown in FIGS. 13, 14 and 15, above the first plate 6 there is a second plate 800 provided with projecting edges 801 having the same shape as the underlying hardened sleeves 71.

The second plate 800 lies above the film 91, and is driven by means (of known type, not shown) which cause it to press the film 91 against the upper surface of the underlying backing/centering plate 6, and in particular against the sleeves 71.

The projecting edges 801 of the plate 800 define a corresponding plurality of second apertures 802 corresponding to the first apertures 61 of the first plate 6.

With the plate 800 there are associated thrust means acting on the top of the film 91 to urge the film downwards until it adheres against the surface of the top end of the group of cans 4.

These thrust means comprise a third plate 80 which for each group of underlying cans 4 lowerly carries a bell-shaped member 840 with a lower cutting edge.

Both the bell-shaped member 840 and the plate 80 are provided with through holes each of which sealedly receives a shank 821 with an axial bore 820, the seal between the shank, plate 80 and bell-shaped member 840 being provided by an O-ring 825 housed in a recess in the plate 80.

At the base of each shank there is a cup 822 the lower edge of which is able to be received as an exact fit within the clinched rim 414 of each can 4.

The cup contains a pad 823 of deformable elastomeric material, the lower surface of which is downwardly convex.

The purpose of said pad is to urge the film 91 against the lid of the can throughout the entire region circumscribed by the clinched rim 414, while undergoing deformation to the extent of occupying substantially all the space within the cup 822.

By virtue of the convex shape of the base of the pad, its thrust action commences at the centre of the top end of each can and propagates from the centre to the periphery.

The bore 820 opens into four radial holes 824, which are provided within the shank 821 immediately above the cup 822, and through which pressurized air can be fed into the bell-shaped member 840.

Said plate 80 and said shanks 821 can be moved vertically upwards and downwards by mutually independent means, not shown.

The cutting edge of the bell-shaped member 840 has a closed profile circumscribing, at a short distance therefrom, the edge of the through apertures 61, to interact with the sleeves 71 of the platen 7.

The cutting edge of the bell-shaped member 840 is continuous along that part involving the external line circumscribing the group of cans, and can be associated with a punch positioned internal to the cap to act against the upper edges of the partitioning baffles 31 to create a tear-off line.

The bell-shaped member 840 is intended to sealedly enter the holes in the underlying second plate 800 as an exact fit, by way of a ring gasket 841 which provides the seal.

The apparatus illustrated in FIGS. 1 to 12 operate as follows.

At the commencement of each capping cycle a succession of trays 2, already containing in their recesses 3 the groups of cans 4, is loaded onto the belt 1.

The advancement of the belt 1 is intermittent and is controlled such that it halts with a tray 2 positioned in the station with its recesses 3 always perfectly aligned with the through apertures 61 in the overlying centering plate 6.

Figure 2:
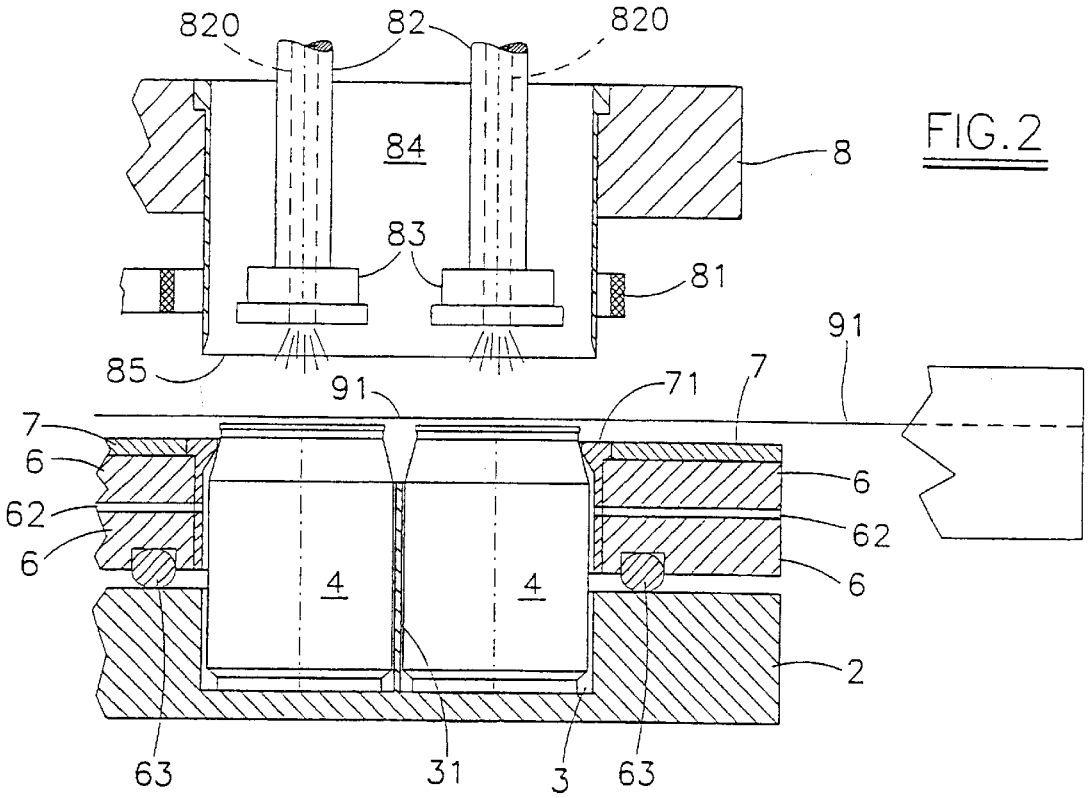
FIGS. 2 to 6 show an enlarged detail of FIG. 1, in respective successive operating positions.

When the belt 1 halts, the plate 6 descends until it rests in a sealed manner, by virtue of the gaskets 63, on the upper surface of the underlying tray 2, as shown in FIG. 2.

Alternatively, as stated, the support surface 11 raises the belt portion 1 to move the tray 2 against the underlying fixed plate 6. In the meantime, the film 91 is heated in the tunnel 13 and immediately afterwards is advanced and brought to overlie the backing/centering plate 6. Advantageously, the heating means within the tunnel are of infrared type, and heat the film portion 91 to a temperature of between 120° C. and 230° C., depending on the type of polymer.

Figure 3:
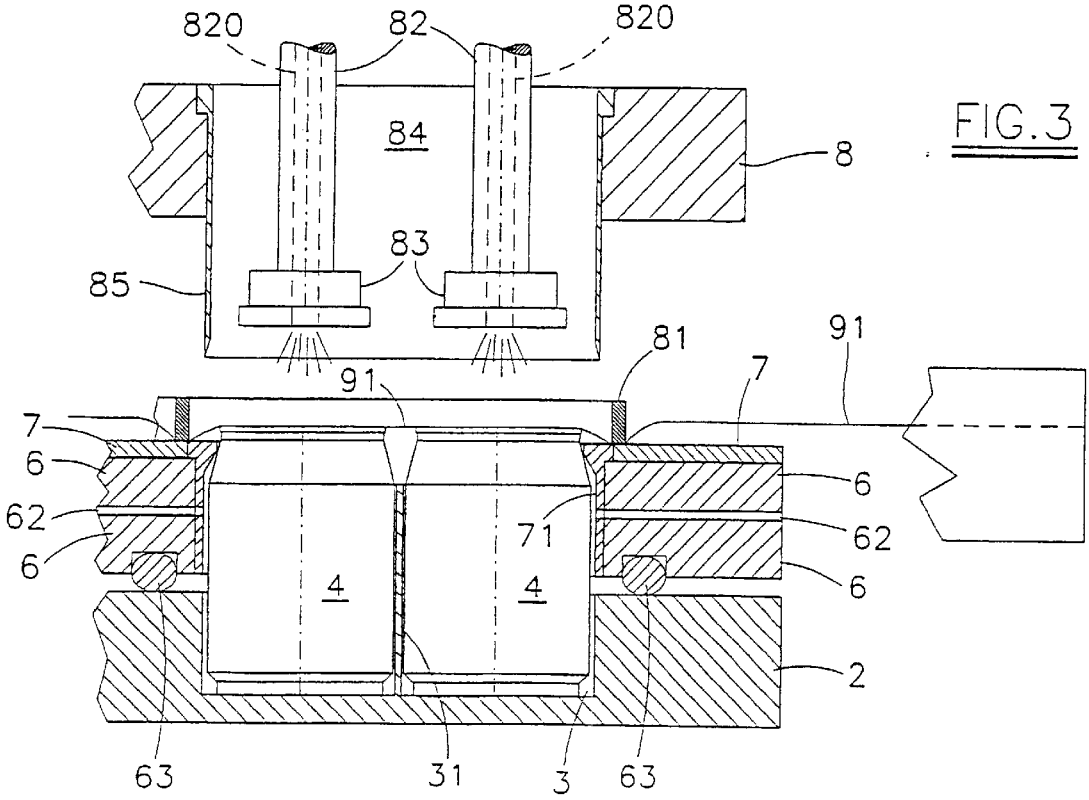
Figure 4:
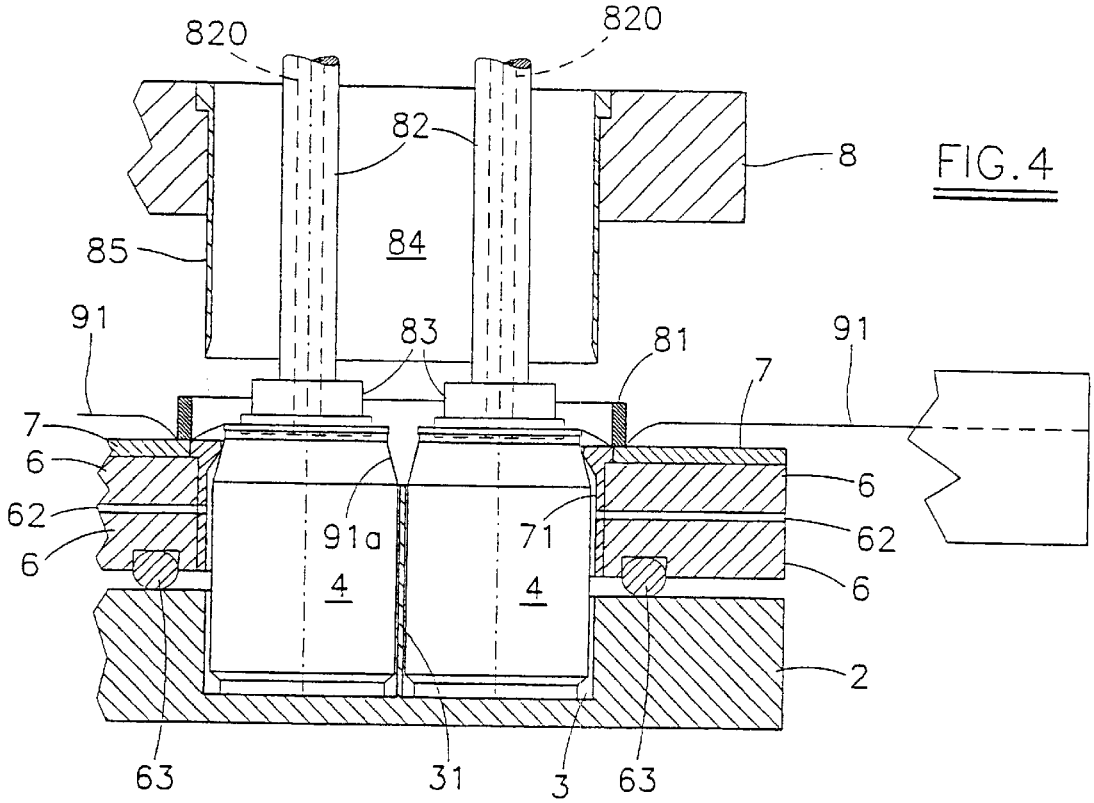

At this point the film pressing grid 81 descends from the plate 8 to stretch the film 91 spread above the heads of the cans 4 which project beyond the platen 7 of the plate 6, as shown in FIG. 3. After the descent of the grid 81 the shanks 82 are made to descend, with simultaneous feed of pressurized air by the conduits 820. This air presses on the underlying film 91 to urge it downwards and hence make it adhere intimately to the surface of the upper part of the cans 4.

The air also forces downwards that portion of the film 91 lying between one can and the other.

This pressing action is followed by the thrust directed by the presser members 83*a* on the top end 412 of the cans 4.

Simultaneously the lower edge of the grid 81 presses the film 91 against the upper surface of the platen 7 to create a circular seal strip through which air does not pass. Consequently, in correspondence with each aperture 61 there forms an interspace (or chamber) between the film 91 and the outer surface of the can 4, which is isolated from the external environment. In detail, this interspace or chamber is defined by the film portion 91 surrounded by the lower edge of the grid 81, by the inner surface of the aperture 61, by the surface of the recess 3, and by the outer surface of the can 4.

At this stage the air present in the interspace is extracted via the channelling 62 with the result that the film portion 91 circumscribed by the grid 81 adheres, by virtue of this downward suction action, to the upper part 411 of the can, to form a cap which is still joined to the rest of the film 91, but exactly matches the shape of the upper part 411 of the can.

In an alternative embodiment, no suction action is created below the film, its adhesion to the upper part of the can being achieved only by the thrust of the air leaving the conduits 820.

In the next stage (FIG. 5), the blades 85 are lowered to produce, in combination with the upper edge of the apertures 61, a corresponding circular closed cut in the film 91. This cut occurs along a closed line surrounding the envelope of the upper parts of the cans, to separate that film portion (cap 91*a*) adhering to the group of cans 4 from the rest of the film 91.

Figure 5:
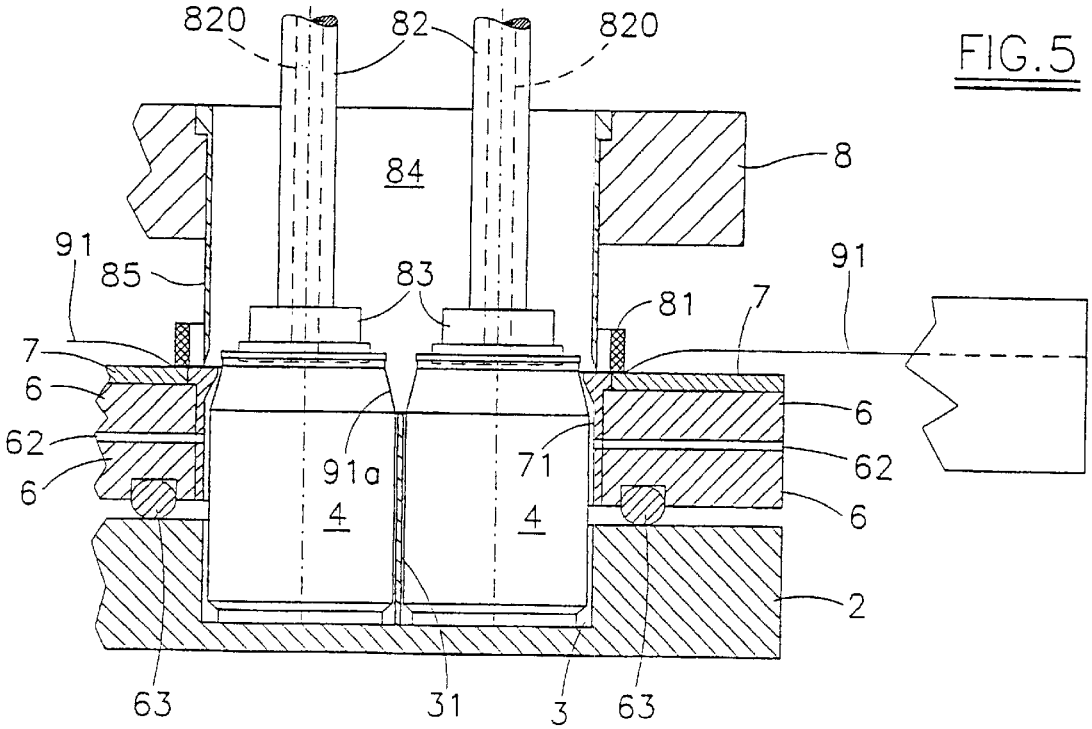

In the embodiment illustrated in FIG. 5, the blade 85 rests on the upper surface of the sleeves 71.

If the film 91 is substantially rigid, it is preferable for the blade 85 to enter the sleeve 71 as an exact fit, grazing the inner corner of the upper edge 61*a* of the aperture 61, to operate as shears.

Figure 6:
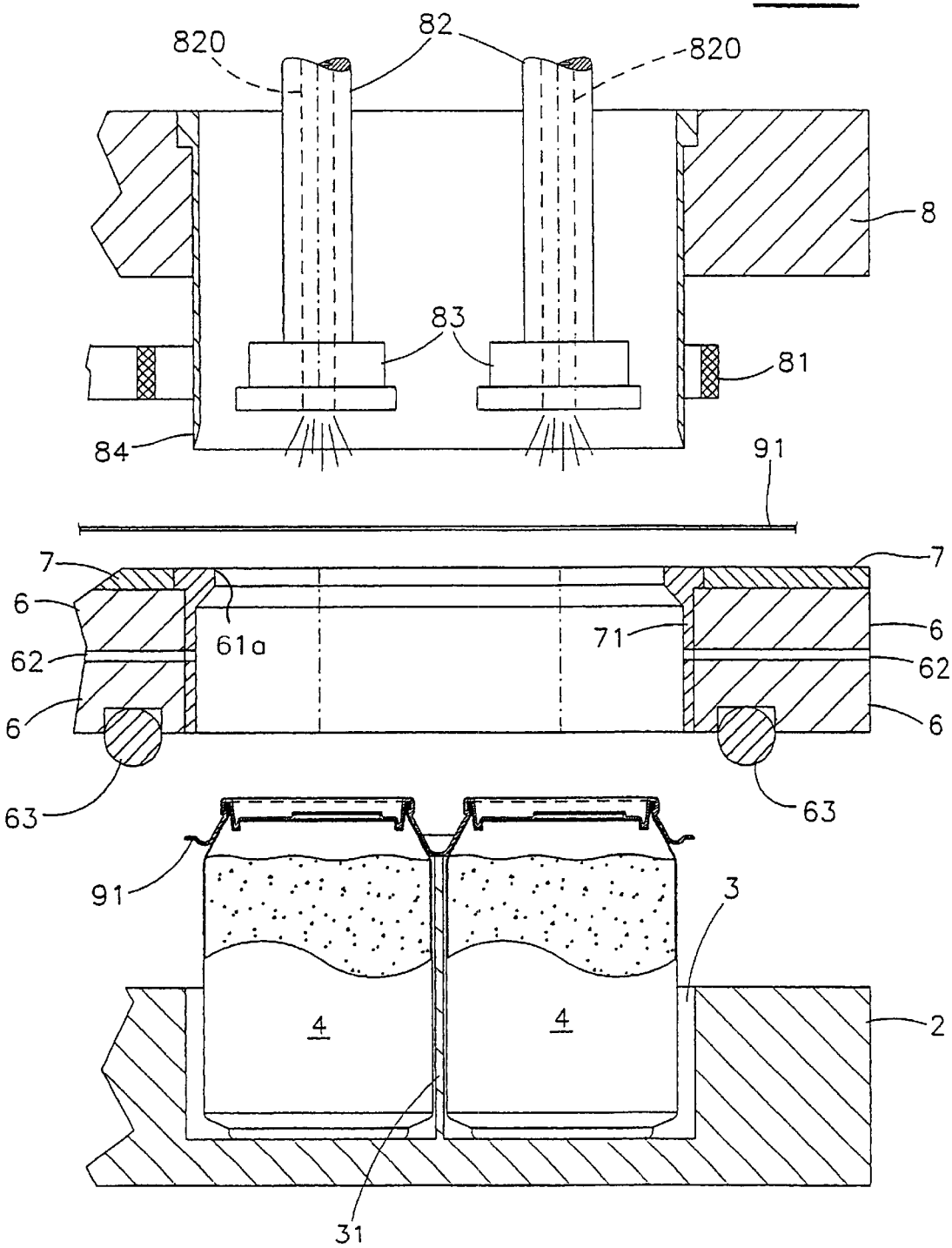

On termination of the cycle all the devices return to their initial position shown in FIG. 6. On cooling, the cap 91*a* maintains the perfectly adhering shape which it has assumed on the upper part of the can, and retains this shape permanently, the cans arranged in each recess of the tray 2 being joined together by the capping film portion 91*a* surrounding their upper part (as in FIG. 7). In addition, the cap 91*a* adheres to the can surface under vacuum, hence covering it hermetically and reliably protecting it from any external contamination.

Figure 9:
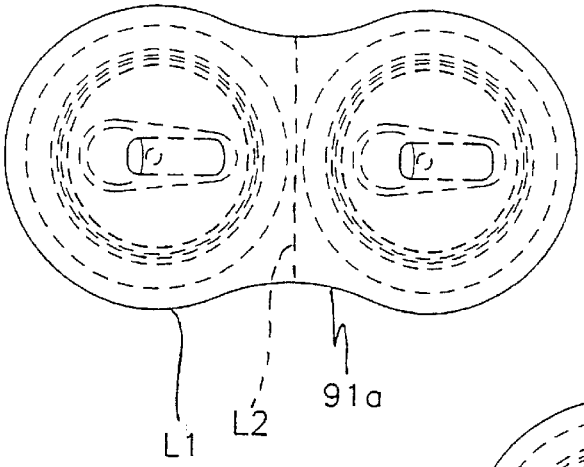
FIGS. 9 and 10 are views from above showing respectively two-can and four-can packs obtained by the apparatus of the invention.
Figure 10:
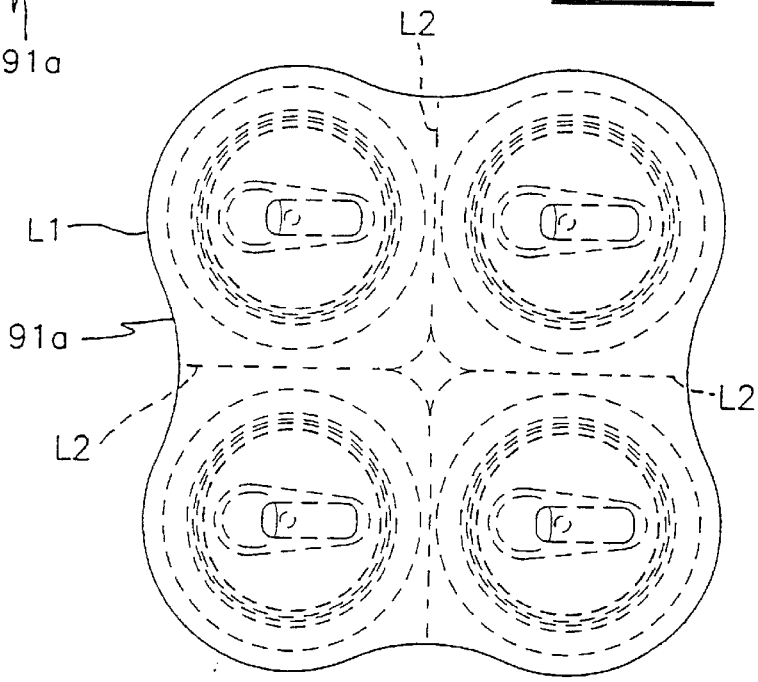

Obviously, the trays and plates 6 will be suitably shaped in plan view to form packs with the required number of cans, as illustrated for example in FIGS. 9 and 10.

Figure 12:
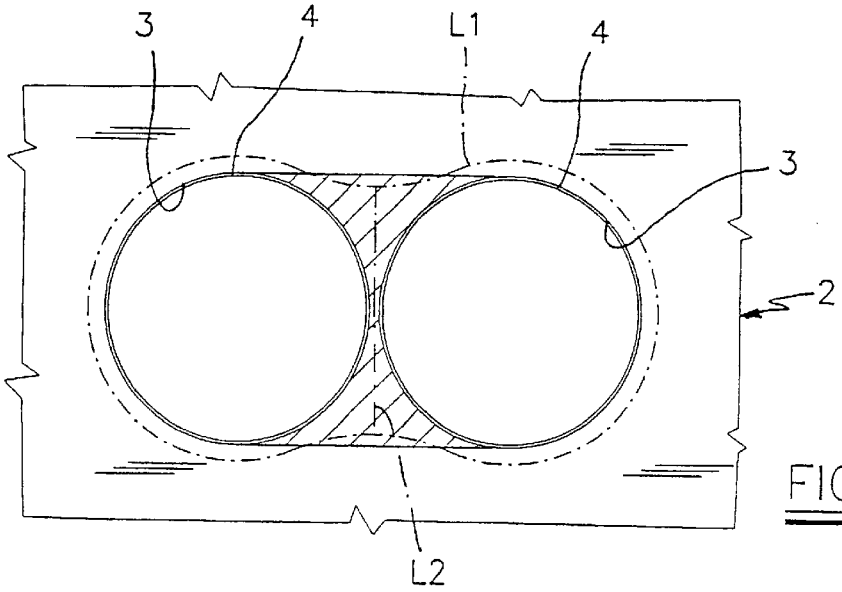
FIG. 12 is a section on the plane XII—XII of FIG. 11.
Figure 11:
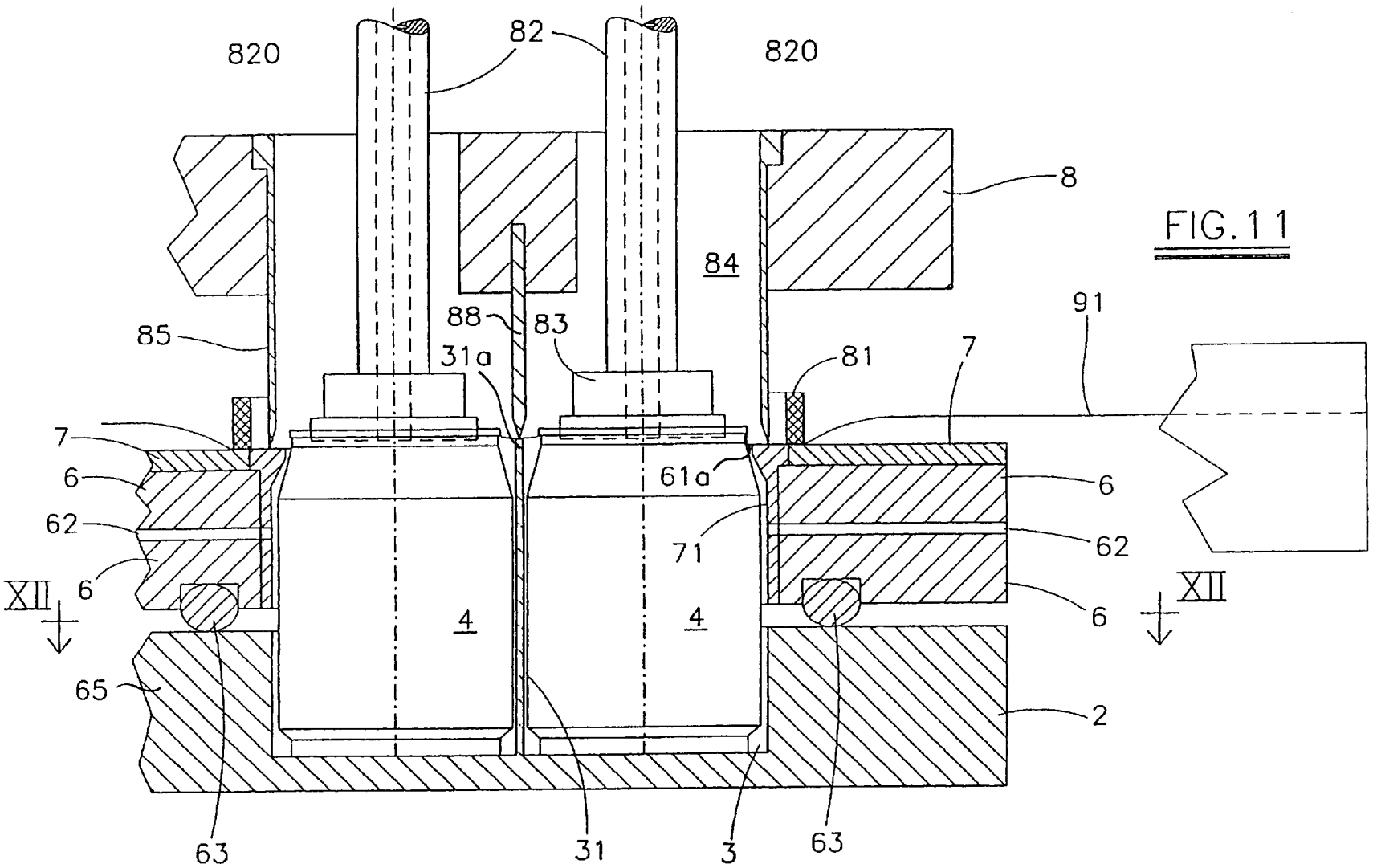
FIG. 11 shows a particular embodiment regarding the incision, for its subsequent separation, of the capping film portion adhering to the cans.

FIGS. 11 and 12 show more clearly the capping of groups of two or more cans.

In this embodiment the recesses 3 to each contain a group of at least two cans, namely four cans 4 in the illustrated example, are shaped such that from their base there upwardly extend, as stated, partitioning baffles 31 occupying the space which would otherwise remain free between one can and another.

The baffles 31 have a height at least equal to the height of the cylindrical part of the cans 4.

In addition to the film cutting means 85, the illustrated apparatus comprises one or more thin punching tools 88 for forming in the film 91, in combination with the upper edge 31*a* of the partitioning baffles 31, a line of weakened film cross-section which separates each individual can from the others.

Said line of weakening is indicated by L2 in FIGS. 9 and 10, and in combination with the cutting line (indicated by L1, which separates the cap portion 91*a* from the rest of the film) surrounds each individual can 4.

Said line L2 can consist of a close-together succession of holes or short cuts separated from each other, or a more or less continuous weakening incision which does not however completely cut through the cross-section.

In particular, the tool 88 consists of a blade the cutting edge of which is toothed, or a succession of needles. In addition, the line of weakening L2 is formed simultaneously with the cutting line L1, by lowering the blades 85 and the bladed tools 88 together.

A group of two or more cans is obtained (see FIGS. 9 and 10) comprising a single capping film portion 91*a* which mates with and covers the surface of the upper part of those cans forming part of the group. However, the line of weakening L2 separates said capping film portion 91*a* into several mutually separated sub-portions, each relative to and associated with an individual can 4. Consequently, the individual cans 4 can be detached from the group,by pulling them away by hand, so that the capping portion 91*a* tears along the line of weakening L2. The can detached from the others retains a sub-portion of the film 91 adhering to its upper part, to continue to act as a protective cap.

In the modification of FIGS. 13 to 15, the shanks 821 are firstly lowered, and the cups 822 become inserted as an exact fit within the can rim 414 such that the pads 823 begin from the centre to press the film 91 against the upper surface of the can, so expelling the peripheral air.

The cup edge comes into contact with the groove defined by the clinching rim only when the pad has completed expulsion of the air, to prevent formation of air pockets in proximity to said rim.

At this point the plate 800 is lowered until by means of its projecting edges 801 it extends the taut film over the projecting heads of the cans 4 and against the platen 7 of the plate 6, as shown in FIG. 13, to form in cooperation with the platen 7 an endless sealing strip through which air does not pass.

When the configuration shown in FIG. 13 is achieved, pressurized air is fed into the bell-shaped member 840 through the conduits 821, 824.

In this manner the compartment defined by the bell-shaped member 840, by the gasket 825, by the edges 801 of the plate 800 and by the film portion 91 circumscribed by said edges is pressurized. The pressure acts on that portion of the underlying film 91 external to the rim 414, urging it downwards and causing it to adhere intimately to the surface of the upper part of the neck of the cans 4.

The pressure created within the bell-shaped member 840 also urges downwards that portion of the film 91 between one can and another until it lies against or in proximity to the upper edge of the baffles 31.

In the next stage the third plate 80 is lowered together with the bell-shaped member 840 the cutting edge of which, in combination with the upper edge of the apertures 61, produces a corresponding circular or endless cut in the film 91.

This cut is made along a closed line which surrounds the envelope of the upper parts of the cans, to separate that film portion adhering to the group of cans 4 from the rest of the film 91.

In the embodiment shown in FIG. 13, the cutting edge of the bell-shaped member enters the sleeve 71 as an exact fit, to act as shears.

In combination with the edge of the bell-shaped member there can also act possible punches, which in cooperation with the upper edges of the baffles 31 form tear-off lines between one can and another.

On termination of the cycle all parts of the device return to their initial position.

On cooling in contact with the cold surface of the can, the film 91 rigidifies to perfectly adhere to the upper part of the cans, and retains this shape permanently.

The cans arranged in each recess of the tray 2 are joined together by the film portion surrounding their upper part.

Obviously, the trays and plates 6, 80 and 800 will be suitably shaped in plan view to form packs with the required number of cans.

Using the illustrated apparatus, groups of cans can be formed into packs without interrupting the flow of their production, by simply inserting the apparatus into the line.

This constitutes one of the many merits of the invention, which by being inserted into the line avoids the need to withdraw the products for their packaging and further manipulation, to the advantage of production economy.

It should also be noted that with one and the same apparatus, cans of different height but of the same cross-section can be formed into packs, by simply adjusting the distance between the conveyor and the plate combination 6 and 8, 800 together with their accessories.

What is claimed is:

1. A method for capping cans having an upper part formed of a substantially flat top end, an upper frustoconical neck and a circular rim which connects the flat top end to the neck, comprising the steps of placing a portion of a film of thermoformable plastic material on the upper part of the can in contact with an upper edge of the rim to define a closed chamber in combination with the upper edge of the rim;

heating the film to a thermoformable temperature;

extracting air from the chamber followed by cooling which causes the film to harden and intimately adhere to the flat top end of the can which it covers, retaining its shape, wherein the air is extracted from the chamber by a thrust action exerted by a compressed air jet applied to the top of the film covering the upper part of the cans.

2. The method as claimed in claim 1, wherein a thrust action exerted by the compressed air jet takes place in combination with the thrust action exerted by a deformable elastic pad and limited to a region circumscribed by the can circular rim.

3. The method as claimed in claim 2, wherein the action of the elastic pad takes place in combination with the action of a lower cutting edge of a rigid cup containing the pad.

4. The method as claimed in claim 3, wherein the action of the pad precedes the action of the edge of the rigid cup.

5. The method as claimed in claim 2, wherein the thrust action exerted by the deformable elastic pad precedes the thrust action exerted by the compressed air.

6. The method as claimed in claim 2, wherein the thrust action exerted by the pad commences from the center of the can lid and propagates towards the periphery thereof, defined by the circular rim.

7. The method as claimed in claim 1, wherein film portions adhering to the upper part of the cans are separated by cutting along a closed line positioned on the frusto conical neck of each can.

8. The method as claimed in claim 1, wherein film portions adhering to the upper part of the cans are separated by cutting along a closed line which closely surrounds a line constituting an envelope of the upper part of at least two cans.

9. An apparatus for capping cans arranged in recesses of a tray, comprising an overlying first center plate having a plurality of first through apertures corresponding to the underlying recesses for receiving an upper part of the cans so that they project beyond an upper surface of the centering plate;

means for positioning a heated web of plastic material above the projecting upper part of the cans;

means for causing the web to adhere to the top of said cans and means for separating that web portion adhering to the top of the cans from the rest of the web, wherein a second plate overlays said first plate and has second apertures which correspond to the underling first apertures, the lower edge of said second apertures projecting and arranged to press the film against the upper surface of said first plate;

an overlying third plate lowerly carrying bell-shaped members for sealed insertion into said second apertures;

an inverted cup member contained in each of said bell-shaped members coaxial with the cans contained in said first apertures, and having a dimension corresponding to the flat top edge of the cans;

a pad contained in said cup member;

each cup member being supported by a shank sealedly slidable within a hole in the base of said bell-shaped member, and having an axial conduit which opens outside of the cup member and into an interior of the bell-shaped member;

means for vertically moving the plates and the cups independently of each other; and means for feeding the axial conduit with compressed air.

10. The apparatus as claimed in claim 9, wherein at least two cans are disposed in each recess of the tray.

11. The apparatus as claimed in claim 9, wherein the pads are made of elastically yieldable elastomeric material and have a convex lower surface arranged to press the plastic film against the top end of the cans, its lowest point being positioned substantially at the center of the top of the cans.

12. The apparatus as claimed in claim 9, wherein the film cutting means are the lower cutting edge of the bell-shaped member, which has a closed profile circumscribing, at a short distance therefrom, the edge of the first through apertures of the first plate.

13. The apparatus as claimed in claim 10, wherein the recesses which contain at least two cans are provided with partitioning baffles which extend upwards from their base to occupy free space between adjacent cans, said baffles having a height substantially equal to the cylindrical part of the cans.

14. The apparatus as claimed in claim 13, wherein within the bell-shaped member there is provided at least one thin punching tool for forming the film in combination with the upper edge of the partitioning baffles, and a line of weakened film which separates each can of the group from the others.

15. A group of at least two cans for containing food products or drinks, comprising a single film portion which mates with and covers a surface of an upper part of the cans forming part of the group, wherein the film has a weakened line which divides the film portion into several parts, each part involving a single can of the group, said film mating with the surface of the upper part of each can.

* * * * *